United States Patent [19]

Masuda et al.

[11] 4,256,069

[45] Mar. 17, 1981

[54] LUBRICANT OIL LEVEL DETECTING DEVICE FOR INTERNAL COMBUSTION ENGINES

[75] Inventors: Yutaka Masuda, Iwata; Seisaku Ota, Hamakita, both of Japan

[73] Assignee: Yamaha Hatsudori Kabushiri Kaisha, Tokyo, Japan

[21] Appl. No.: 15,622

[22] Filed: Feb. 27, 1979

[30] Foreign Application Priority Data

| | | | |
|---|---|---|---|
| Feb. 28, 1978 | [JP] | Japan | 53-22211 |
| Feb. 28, 1978 | [JP] | Japan | 53-25107[U] |
| Feb. 28, 1978 | [JP] | Japan | 53-25108[U] |
| Mar. 29, 1978 | [JP] | Japan | 53-41417[U] |

[51] Int. Cl.[3] ..... F01M 1/00

[52] U.S. Cl. ..... 123/196 S; 184/6.4

[58] Field of Search ..... 123/196 S; 184/6.4

[56] References Cited

U.S. PATENT DOCUMENTS

| | | | |
|---|---|---|---|
| 1,208,286 | 12/1916 | Campbell | 184/6.4 |
| 2,836,164 | 5/1958 | Kinney | 184/6.4 |
| 3,499,130 | 3/1970 | Norred | 184/6.4 |

*Primary Examiner*—Ronald H. Lazarus

*Attorney, Agent, or Firm*—Kerkam, Stowell, Kondracki & Clarke

[57] ABSTRACT

Lubricant oil level detecting device adapted to be located in an oil sump provided in the engine crankchamber so that lubricant oil in the sump is splashed by a splashing bar formed in the connecting rod. A shield is provided between the detecting device and the splashing bar for dividing the sump into two sections which are connected together through openings in the shield. The shield is effective to absorb the movement of the oil surface under the influence of the splashing bar.

6 Claims, 8 Drawing Figures

LUBRICANT OIL LEVEL DETECTING DEVICE FOR INTERNAL COMBUSTION ENGINES

The present invention relates to internal combustion engines having lubricant oil storing sumps in crankchambers and more particularly to oil level detecting means adapted for use in such oil sumps. More specifically, the present invention pertains to means for stabilizing free surface of the lubricant oil around the oil level detecting means.

Conventional internal combustion engines are generally provided at the bottom portions of crankchambers with lubricating oil sumps and connecting rods extending between pistons and crankshafts carry oil splashing bars which function to splash lubricant oil in the sumps in each rotation of the crankshafts to cylinder portions of the engines. In such types of engines, oil level detecting means is provided in the oil sump in order to detect the level of the lubricant oil. In some types of engines, means is also provided for stopping the engine when the detecting means has found that the oil level has decreased below a predetermined value.

In the engines having the aforementioned types of oil level detecting means, there is an inherent problem in that the lubricant oil in the sump is displaced due to the cyclic movement of the splashing bar in the direction of the movement of the bar so that the free surface of the oil is displaced accordingly causing errors in the operation of the detecting means. Particularly, when the amount of the oil in the sump is close to the lower limit, the oil detecting means may be actuated when the oil surface is displaced and, where the engine is provided with means for stopping the engine, the engine speed starts to decrease as soon as the oil detecting means is actuated. Such decrease in the engine speed may allow the oil surface to restore the horizontal position and the oil detecting means may then be returned to its normal position so that the engine may be started again. Thus, the engine may possibly repeat stop-and-start operations due to the movement of the oil surface. Such repeated stop-and-start operations have an adverse effect on the life of the engine and cause repeated changes in the engine speed which, in case where the engine is used in an engine generator, undesirably affect the output voltage of the generator. The problem is particularly significant in starting period of the engine in which the lubricant oil is at a lower temperature and has relatively large viscosity.

It is therefore an object to provide accurate oil level detecting means having means for eliminating or at least substantially decreasing the effect of movement of the oil surface due to the cyclic action of the oil splashing bar.

Another object of the present invention is to provide oil level detecting means which can readily be assembled and installed on the engine crankcase.

A further object of the present invention is to provide oil level detecting means which can provide a reliable function even under presence of foreign matters in the oil sump.

According to the present invention, the above and other objects can be accomplished by an internal combustion engine comprising cylinder means, piston means disposed in said cylinder means for reciprocating movement therein, crankcase means defining crankchamber means beneath the cylinder means and having lubricant oil sump means defined therein, crankshaft means disposed in said crankchamber means and connected with said piston means through connecting rod means, oil splashing means movable with said crankshaft means along a path for splashing lubricant oil in said sump means toward said cylinder means, lubricant oil level detecting means including detecting switch means disposed in said sump means so that it is actuated when amount of the lubricant oil is decreased beyond a predetermined level, shield means provided in said sump means at least between the path of the splashing means and the detecting switch means to divide the sump into sections which are communicated with each other at a level below the detecting means. In the simplest mode of the present invention, the shield means is comprised of partition wall means having communicating passage means at lower portion thereof. Alternatively, the shield means may be in the form of cover means having side wall means and bottom wall means encircling the side and bottom portions of the switch means. Communication opening means may be formed preferably in the bottom wall means of the casing means.

According to the features of the present invention, the lubricant oil around the detecting switch means can be maintained substantially free from any influence of the splashing means so that the detecting switch means can sense accurately the level of the lubricant oil. It is therefore possible to avoid the aforementioned repeated stop-and-restart operations of the engine which has hithertofore been experienced when the amount of oil is close to the lower allowable limit.

For the purpose of installing the detecting switch means, the crankcase means may be formed with opening means to which plug type support means may be liquid-tightly fitted and the detecting switch means may be mounted on the support means. Where the shield means is in the form the aforedescribed casing means, it may also be secured to or detachably mounted on the support means. The casing means should in such an instance preferably be of such a configuration that facilitates insertion and removal of the switch means through the opening means in the crankcase means. The casing means may preferably be provided at the bottom wall means with at least one upwardly projected portion where the communication opening is formed. The arrangement is advantageous in that it is possible to avoid any possibility of the communicating opening being clogged by foreign matters such as straw chips, leaves or the like.

The above and other objects and features of the present invention will become apparent from the following descriptions of preferred embodiments taking reference to the accompanying drawings, in which.

Figure 1:
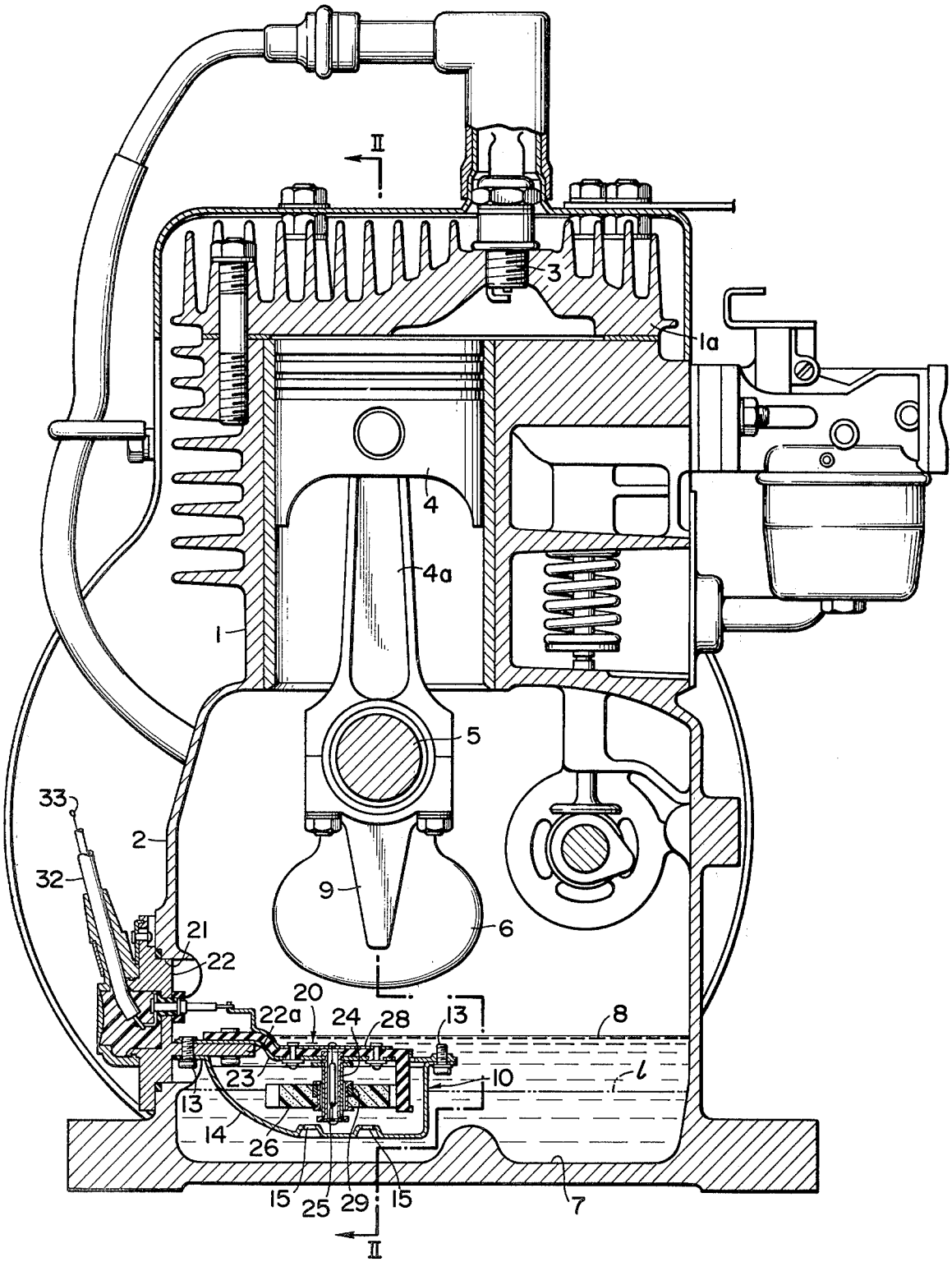
FIG. 1 is a sectional view of an internal combustion engine in accordance with one embodiment of the present invention.
Figure 2:
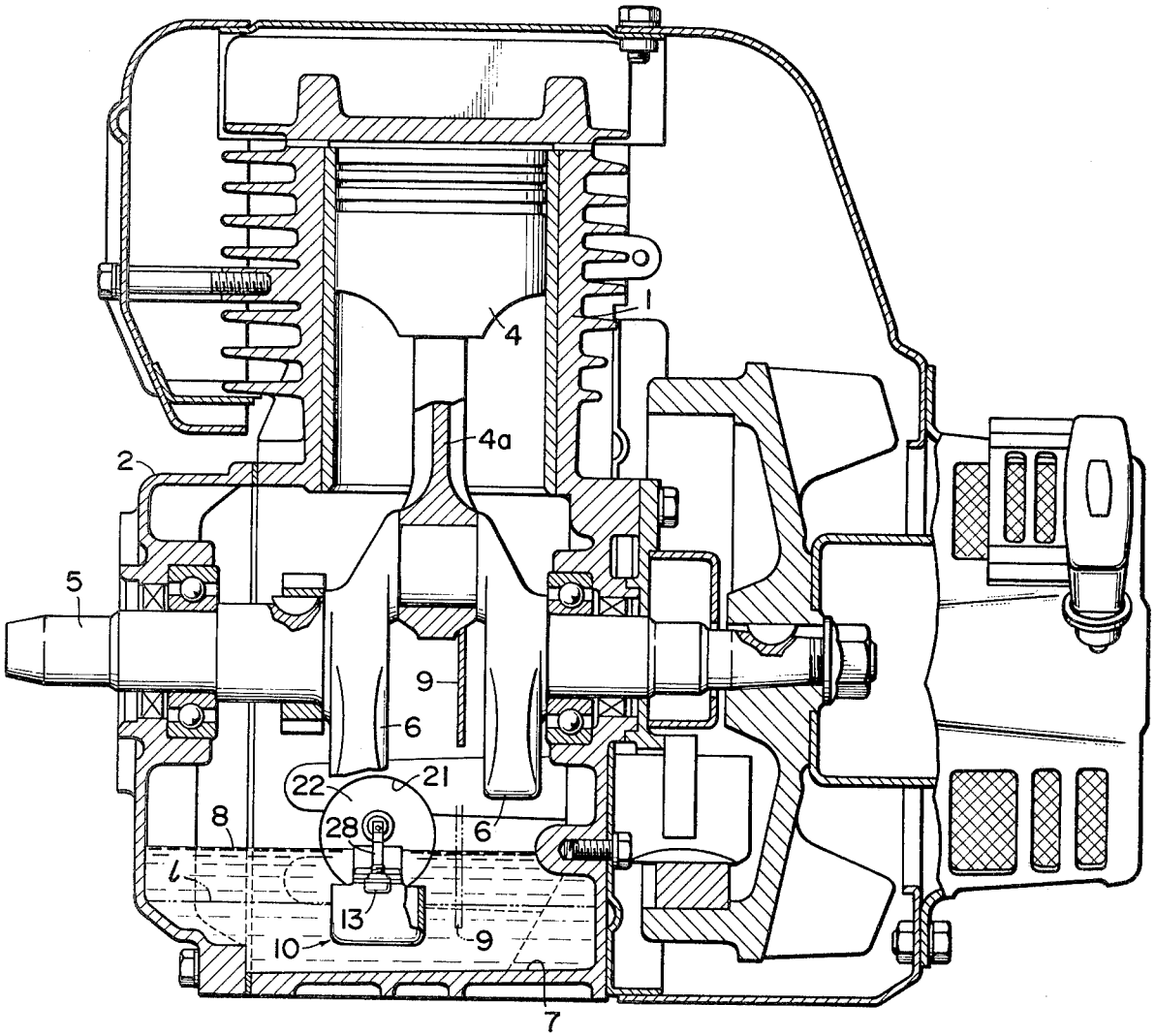
FIG. 2 is a sectional view taken substantially along the line II—II in FIG. 1.

Referring now to the drawings, particularly to FIGS. 1 and 2, the engine shown therein includes a cylinder 1 having a cylinder head 1*a* at the upper end and a crankcase 2 at the lower end thereof. An ignition plug 3 is mounted on the cylinder head 1*a* as in conventional engines. In the cylinder 1, there is disposed a piston 4 for reciprocating movement therein. The crankcase 2 defines a crankchamber 2*a* and carries a crankshaft 5 having crankwebs 6. As well known in the art, the piston 4 is connected with the crankshaft 5 through a connecting rod 4*a*. In the crankchamber 2*a*, there is defined a lubricating oil sump 7 to store lubricant oil 8. The connecting rod 4*a* has an oil splashing bar 9 which is formed integrally therewith and adapted to be moved cyclically into the oil 8 to splash the oil toward the cylinder 1.

Figure 3:
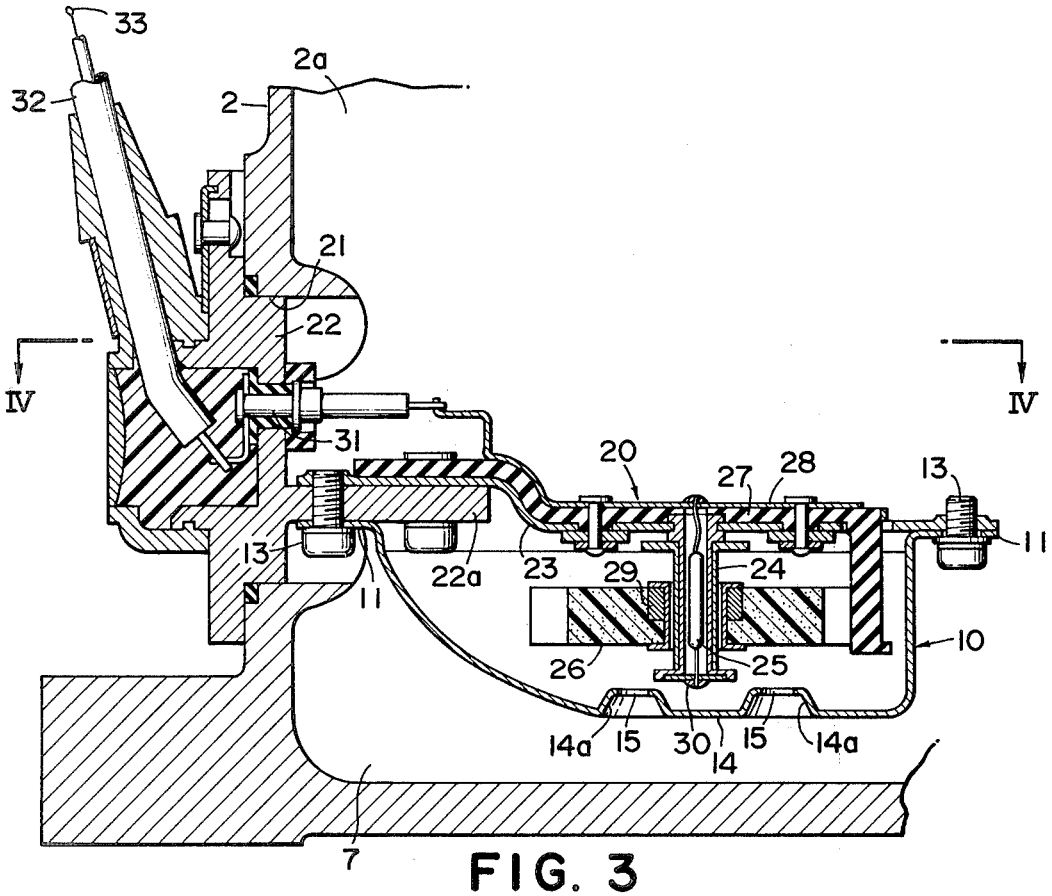
FIG. 3 is an enlarged fragmentary sectional view specifically showing the oil level detecting switch arrangement.
Figure 4:
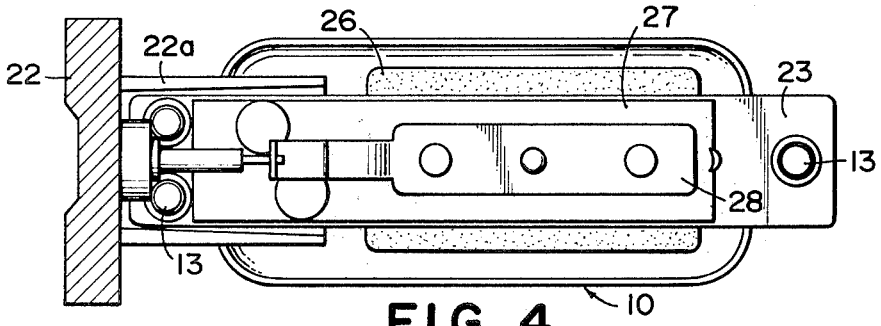
FIG. 4 is a view taken substantially along the line IV—IV in FIG. 3.

In the crankchamber 2*a*, there is provided an oil level detecting device 20 for detecting the level of the free surface of the oil 8 in the sump 7. Referring specifically to FIGS. 3 and 4, the device 20 includes a plug type support 22 which is fitted to an opening 21 formed in the crankcase 2. The support 22 has a horizontally extending shelf 22*a* which carries a support arm 23 for mounting a switch assembly. The switch assembly is comprised of a switch holder 24 which is supported at the upper end by the arm 23. The switch holder 24 is of a hollow cylindrical configuration and has a reed type detecting switch 25 disposed in the hollow interior of the holder 24. The switch 25 is connected at one end with an electrically conductive plate 28 which is mounted on the arm 23 through an insulative layer 27. The other end of the switch 25 is connected with a lower limit stopper 30 provided at the lower end of the switch holder 24 and made of an electrically conductive material. A float 26 is fitted to the outside of the switch holder 24 for slidable movement along the cylindrical outer wall of the switch holder 24. The float 26 is made of a foamed plastic material having a rectangular configuration as shown in FIG. 4 and carries a magnet 29 at the inner periphery thereof. The switch 25 is of a normally open type but closed when the magnet 29 on the float 26 is lowered below a predetermined level.

The detecting device 20 is mounted in the crankchamber 2*a* in such a way that the switch assembly is located in the lubricant oil 8 at a desired level. The conductive lower stopper 30 is grounded through the switch holder 24, the arm 23, the shelf 22*a* and the support 22 to the crankcase 2. The conductive plate 28 is connected, through a conductive pin 31 mounted through an insulator on the support 22, and then through a wire 32 to a terminal 33 which is in turn connected with a detecting circuit 40.

Figure 5:
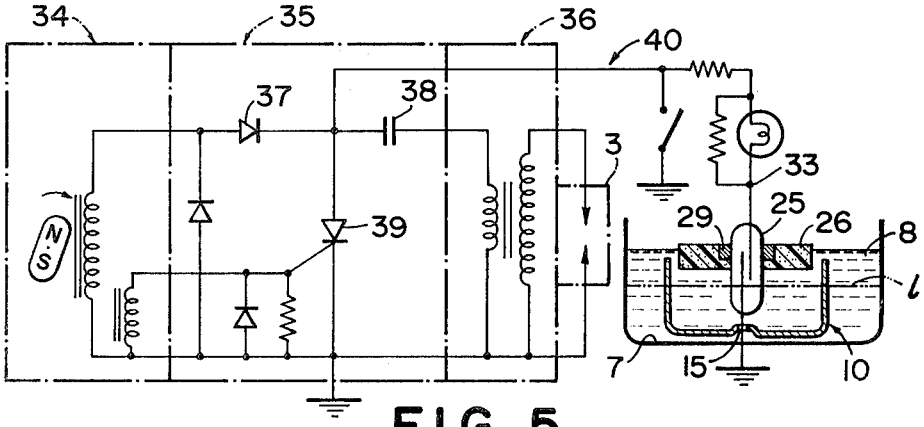
FIG. 5 is a diagram showing an electric circuit in the oil level detecting means.

In FIG. 5, there is shown an example of the detecting circuit 40 which includes a generator coil section 34, an ignition control circuit 35 and an ignition coil 36 connected with the ignition plug 3. The ignition control circuit 35 is of a conventional capacitor discharge type having a charging diode 37, a capacitor 38 and a thyrister 39 for governing the discharge of the capacitor 38. The terminal 33 from the detecting device 20 is connected through a warning lamp to the ignition control circuit 35 at a portion between the diode 37 and the capacitor 38. It will therefore be seen that as the level of the lubricant oil 8 in the sump 7 is decreased beyond the allowable lower limit 1, the reed type switch 25 is closed under the influence of the magnet 29 so that the capacitor 38 is grounded. Under the situation spark discharge is no longer produced at the ignition plug 3 so that the engine is stopped.

In the illustrated embodiment of the present invention, in order to eliminate any undesirable influence of displacement of the lubricant oil surface under the action of the splashing bar 9, the switch assembly is encircled at side and bottom portions by a cover or casing 10 which has a peripheral flange 11 attached to the shelf 22*a* and the arm 23 through screws 13.

The bottom portion 14 of the cover 10 is upwardly projected as shown by 14*a* to provide downwardly opened recesses therein. Communication openings 15 are formed in respective ones of the recesses. The upper edge of the cover 10 is located slightly above the allowable lower limit 1 of the oil level so that, when the amount of oil is decreased to such an extent that the oil surface is close to the limit 1, the inside of the cover 10 is communicated with the oil 8 in the sump 7 only through the openings 15. It is therefore possible to prevent the movement of the oil surface in the sump 7 from being directly transmitted to the inside of the cover 10 but to have such movement of the oil surface absorbed by properly determining the areas of the openings 15 before it is transmitted to the inside of the cover 10.

The illustrated embodiment is advantageous in that the switch assembly and the cover 10 can be preliminary mounted on the plug type support 22 in the form of a subassembly which is thereafter inserted into the crankchamber 2*a* through the opening 21 in the crankcase 2. In order to facilitate such insertion, the bottom portion of the cover 10 may preferably be inclined at the side adjacent to the support 22 as shown in FIG. 3. The cover 10 of the illustrated embodiment is further advantageous in that the communication openings 15 are formed in the recessed portions 14*a* of the bottom wall so that it is possible to eliminate or decrease any possibility that the openings 15 are clogged by foreign matters such as straw chips, leaves or the like which may often be inadvertently allowed to enter the crankchamber 2*a* in a multi-purpose engine.

Figure 6:
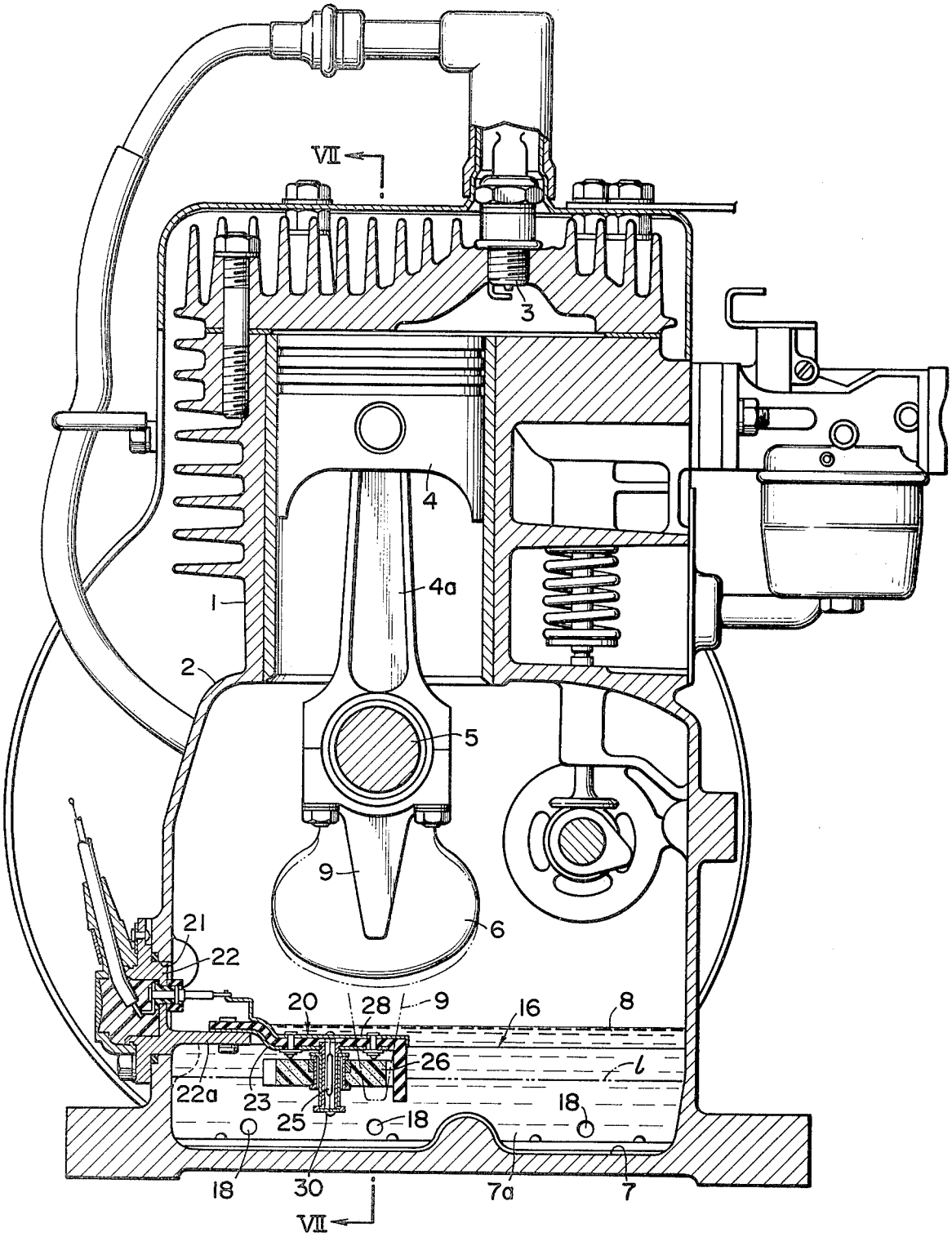
FIG. 6 is a sectional view similar to FIG. 1 but showing another embodiment of the present invention.
Figure 7:
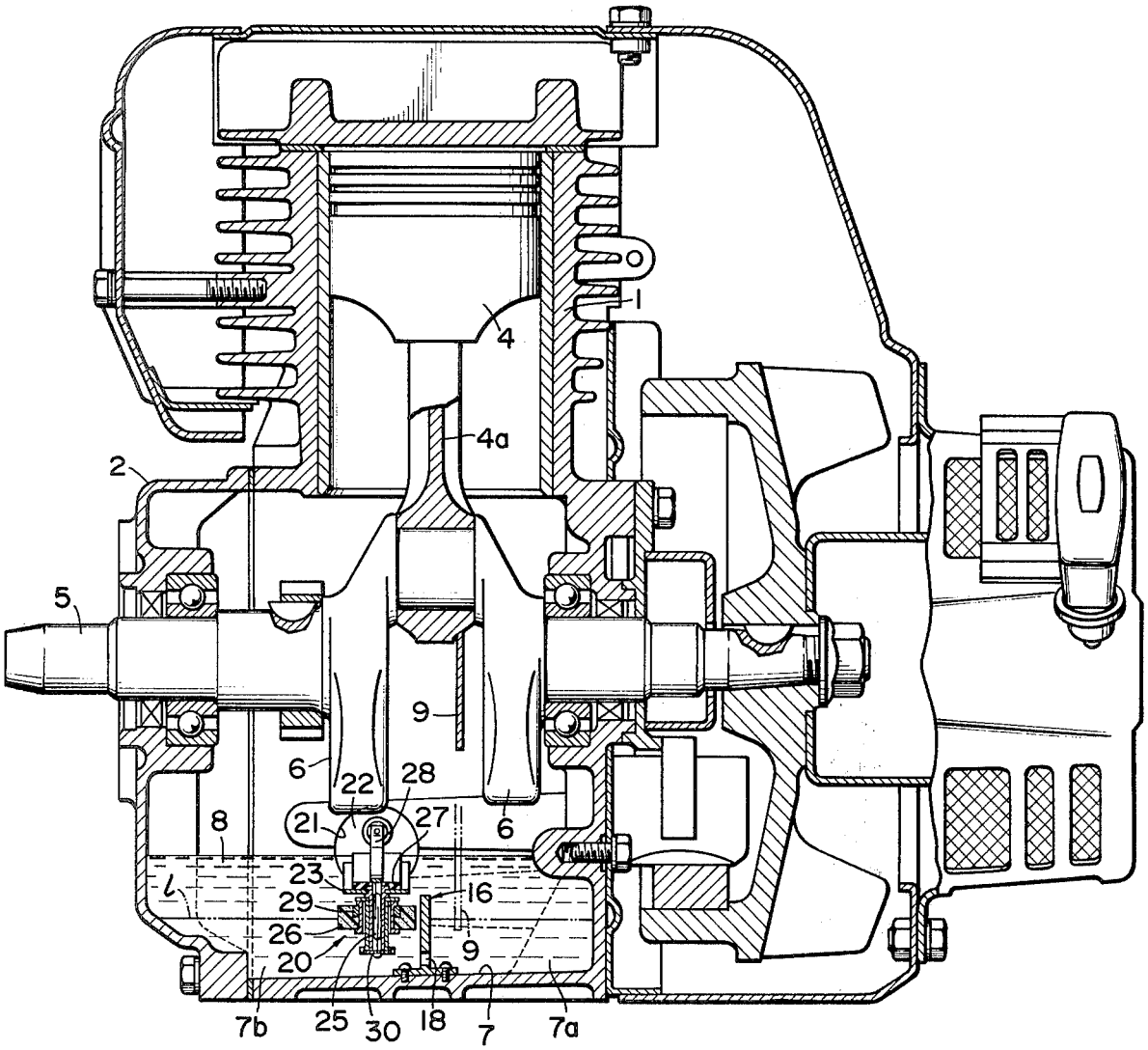
FIG. 7 is a sectional view taken substantially along the line VII—VII in FIG. 6; and, FIG. 8 is a fragmentary sectional view similar to FIG. 3 but showing a further embodiment.

Referring now to FIGS. 6 and 7, the engine shown therein is different from the previous embodiment in that the cover 10 for the switch assembly is substituted by a partition plate 16 which is secured to the bottom of the crankcase 2 and extends upwardly throughout the width of the oil sump 7 to divide the sump 7 into a sump section 7*a* and 7*b*. The partition plate 16 has an upper edge which is located slightly above the allowable lower limit 1 of the oil surface and is provided at the lower portion with communication openings 18. It should be course be noted that, although the partition plate 16 is formed in this embodiment separately from the crankcase 2 and secured thereto by an appropriate means, the plate 16 may be casted integrally with the crankcase 2.

Figure 8:
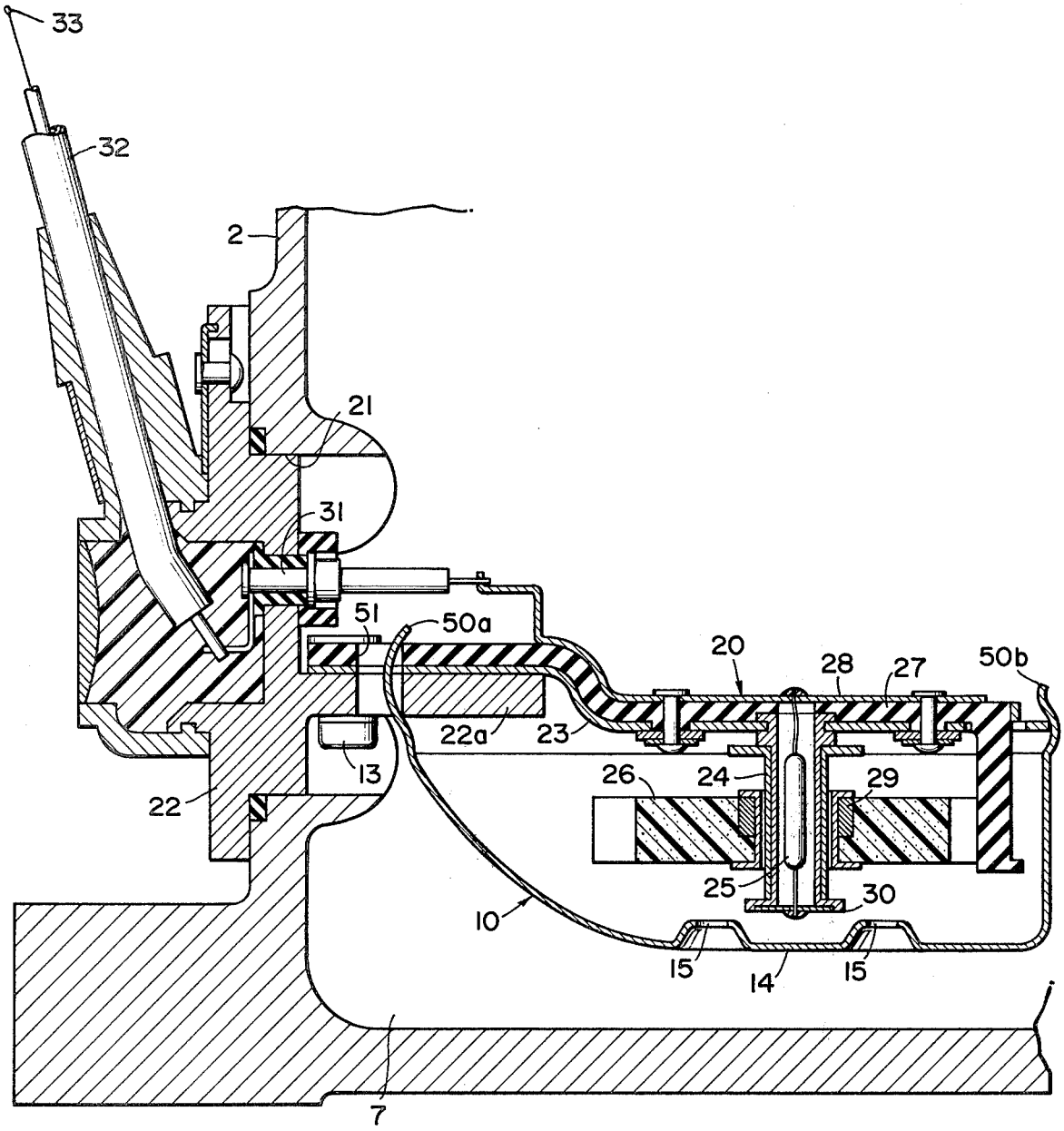

Referring to FIG. 8 which shows a further embodiment of the present invention, the cover 10 for the switch assembly is removably attached to the shelf 22*a* on the support 22 and the arm 23. More specifically, the cover 10 is formed at the side adjacent to the support 22 with an upwardly extending resilient lip 50*a* and at the opposite side with an upwardly extending resilient lip 50*b*. The lip 50*a* is inserted into a hole 51 formed through the shelf 22*a*, the arm 23 and the insulating layer 27, and resiliently engaged with the edge of the hole 51. The lip 50*b* is resiliently engaged with the free end of the arm 23. In other respects, the arrangements are the same as the embodiment shown in FIGS. 1 through 5.

The invention has thus been shown and described with reference to specific embodiments, however, it should be noted that the invention is in no way limited to the details of the illustrated structures but changes and modifications may be made without departing from the scope of the appended claims.

We claim:

1. Internal combustion engine comprising cylinder means, piston means disposed in said cylinder means for reciprocating movement therein, crankcase means defining crankchamber means beneath the cylinder means and having lubricant oil sump means defined therein, crankshaft means disposed in said crankchamber means and connected with said piston means through connecting rod means, oil splashing means movable with said crankshaft means along a path for splashing lubricant oil in said sump means toward said cylinder means, lubricant oil level detecting means including detecting switch means disposed in said sump means so that it is actuated when amount of the lubricant oil is decreased beyond a predetermined level, shield means provided in said sump means at least between the path of the splashing means and the detecting switch means to divide the sump into sections which are communicated with each other at a level below the detecting means, said shield means comprising cover means encircling side and bottom portions of the detecting switch means and provided with communication passage means.

2. Engine in accordance with claim 1 in which said crankcase means is formed with opening means and said detecting switch means is carried on plug type support means adapted to be liquid-tightly fitted to the opening means being comprised of cover means encircling side and bottom portions of the detecting switch means and attached to the support means, communicating passage means provided in said cover means.

3. Engine in accordance with claim 2 in which said cover means is provided with resilient lip means which is adapted to be detachably engaged with said support means for removably mounting the cover means on the support means.

4. Engine in accordance with claim 2 in which said cover means is secured to the support means.

5. Engine in accordance with claim 2 in which said cover means has bottom wall means which is inclined at portions adjacent to the opening means in the crankcase means so as to facilitate insertion of the switch means into the crankchamber means.

6. Engine in accordance with claim 2 in which said cover means has bottom wall means having at least one upwardly projected portion which defines a downwardly opened recess, said communication passage means being formed in said upwardly projected portion.

* * * * *